US005810165A

United States Patent [19]

Lai

[11] Patent Number: 5,810,165

[45] Date of Patent: Sep. 22, 1998

[54] WRISTWATCH HOLDER WITH SECURABLE PROTRUDING MEMBER

[75] Inventor: Jimmy S. Lai, Oakland, Calif.

[73] Assignee: Golden State International, Oakland, Calif.

[21] Appl. No.: 767,717

[22] Filed: Dec. 17, 1996

[51] Int. Cl.[6] ..... B65D 85/40

[52] U.S. Cl. ..... 206/301; 206/18

[58] Field of Search ..... 206/18, 301; 968/294, 968/295, DIG. 1

[56] References Cited

U.S. PATENT DOCUMENTS 4,830,181 5/1989 Hartman ..... 206/45.19

5,383,552 1/1995 Dikowitz ..... 206/6.1

5,579,906 12/1996 Fabbri et al. ..... 206/301

5,655,655 8/1997 Herzog ..... 206/301

*Primary Examiner*—David T. Fidei

*Attorney, Agent, or Firm*—Limbach & Limbach LLP

[57] ABSTRACT

A wristwatch holder assembly includes a wristwatch holder and a box. The wristwatch holder has a wristwatch support member and a flange which can be secured to the box. The flange extends outwards from the wristwatch support member in a thickness direction of the wristwatch support member.

18 Claims, 6 Drawing Sheets

WRISTWATCH HOLDER WITH SECURABLE PROTRUDING MEMBER

BACKGROUND OF THE INVENTION

The present invention relates to merchandise displays, holders and assemblies for merchandise such as wristwatches or jewelry. More specifically, the present invention relates to merchandise holders which can be secured in a merchandise holder support assembly.

DESCRIPTION OF THE RELATED ART

FIGS. 1A to 1C show an embodiment of a first conventional wristwatch holder 1. As shown in FIGS. 1A and 1B, the wristwatch holder 1 includes a wristwatch support member 10 shaped so that a wristwatch can be placed around the wristwatch support member 10 in the shape of a loop.

A flange 12 extends outward from the wristwatch support member 10 along a circumferential plane of the loop L1 formed by a wristwatch placed on the wristwatch support member 10. In other words, a wristwatch placed around the wristwatch support member 10 forms a roughly circular loop L1 about center "c". The diametral direction of this loop is shown by an arrow "d" in FIG. 1A. The flange 12 extends outward from the wristwatch support member 10 in the direction d, which is parallel to the circumferential plane of the loop L1.

Formed integrally with flange 12 is base member 14. FIGS. 1A and 1C show a hole 16 which is formed at the juncture of the flange 12 and the base member 14.

FIGS. 2A and 2B show the wristwatch holder 1 assembled with and secured to a box 2. The box 2 includes two peripheral sides 20, and a base side 22 with a hole 24 (shown by dashed lines) formed therethrough. The box 2 also includes a resilient clamp 26.

The base member 14 of the wristwatch holder 1 fits against the base side 22 of the box 2 and is engaged with the box 2 by the resilient clamp 26. When the wristwatch holder 1 is thus engaged with the box 2, the hole 16 in the wristwatch holder 1 is aligned with the hole 24 in the base side 22 of box 2. A tie-band 30 is threaded through the aligned holes 16, 24 and its ends are securely fastened, thereby securing the wristwatch holder 1 to the box 2, as shown in FIGS. 2A and 2B.

It is noted that because the flange 12 extends in the diametral direction d, the wristwatch holder 1 is susceptible to breakage in the vicinity of the juncture between the wristwatch support member 10 and the flange 12. Also, because the tie-band 30 passes through a hole 16 formed at the juncture between the flange and the base member 14, the wristwatch holder is susceptible to breakage at in the vicinity of the juncture between the base member 14 and the flange 12 and/or in the vicinity of the juncture between the wristwatch support member 10 and the flange 12 due to the geometry of the wristwatch holder 1 and the number of bends in the material of the wristwatch holder 1. Specifically, the wristwatch holder 1 has a right angle bend between the wristwatch support member 1 and the flange 12, and another right angle bend between the flange 12 and the base member 14 (having hole 16).

It is further noted that the tie-band 30 secures the wristwatch holder 1 to the box 2 at only a single set of aligned holes 16, 24, thereby placing relatively high stress in the vicinity of the aligned holes 16, 24 when forces are applied to attempt to separate the wristwatch holder 1 from the box 2 against the constraint provided by the tie-band 30.

A second conventional wristwatch holder 3 and box 4 are shown in FIG. 3. The wristwatch holder 3 includes a wristwatch support member 30 with a curved surface 34. A wristwatch band can be placed around the curved surface 34. The wristwatch support member also includes peripheral surfaces 36 on opposite sides of the curved surface 34.

Protruding from each peripheral surface is an ear 38. The ear 38 extends along the peripheral surface 36. The ear can be said to "extend along" the peripheral surface 36 because its longest dimension is in the direction of the peripheral surface 36.

The box 4 includes a box shaped member 40, which has slots 42, 44. The wristwatch holder 3 can be placed in the box 4 so that ear 38 engages with the slot 42. A similar ear on the opposite side of wristwatch holder 30 will engage with slot 44.

The second conventional wristwatch holder 3 and box 4 of FIG. 3 are not secured to each other which makes it easy for shop lifters to remove the wristwatch holder 3 and wristwatch from the box 4. Also, in the second conventional wristwatch holder 3 and box 4, the engagement between the wristwatch holder 3 and box 4 is not very strong due to the relatively thin surface of engagement between the ear 38 and the slot 42. This means that the wristwatch holder 3 and wristwatch can be easily dislodged from box 4.

SUMMARY OF THE INVENTION

It is an object of the present invention to provide durable and secure wristwatch holder and wristwatch holder assembly.

According to the present invention, a wristwatch holder includes a wristwatch support member, and at least one protruding portion or member. The wristwatch support member is shaped so that the wristwatch can be fastened to form a loop around the wristwatch support member. The loop defines a circumferential plane which is parallel to the loop, and has a thickness direction which is perpendicular the circumferential plane of the loop.

The protruding member is formed integrally with the wristwatch band support member and has at least one hole. The protruding member extends outward from the wristwatch support member in the thickness direction. In some embodiments, the major surfaces of the protruding member will be parallel to the thickness direction. In other embodiments, the protruding member may extend outwards in the thickness direction so that its major surfaces (if any) are at angles to the thickness direction.

The hole in the protruding member can be used for securing the wristwatch holder. For example, a tie-band can be run through the hole, in order to secure the wristwatch holding apparatus to, for instance, a wristwatch box with a mounting portion for securing the tie-band.

It is further to be noted that while the preferred embodiment of the present invention is described in the context of holding wristwatches, the present invention can also be used to hold bracelets and other jewelry, and other merchandise which can be formed into a loop.

DETAILED DESCRIPTION OF THE PREFERRED EMBODIMENTS

Figure 1A:
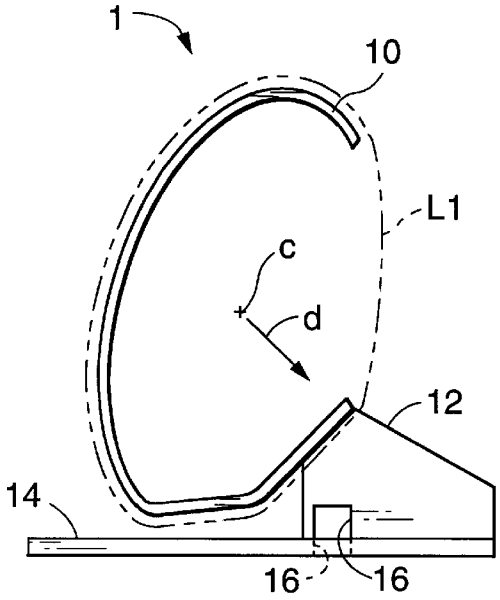
FIG. 1A (PRIOR ART)
FIGS. 1A to 1C are three views of a first conventional wristwatch holder.
Figure 1B:
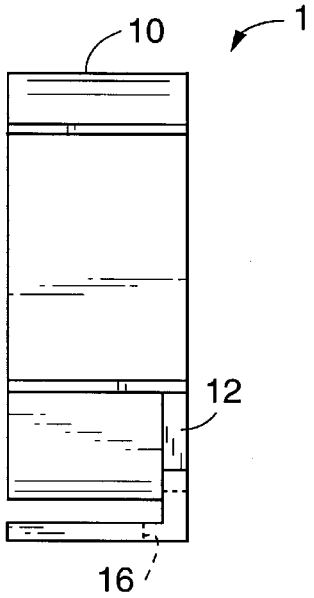
FIG. 1B (PRIOR ART)
Figure 1C:
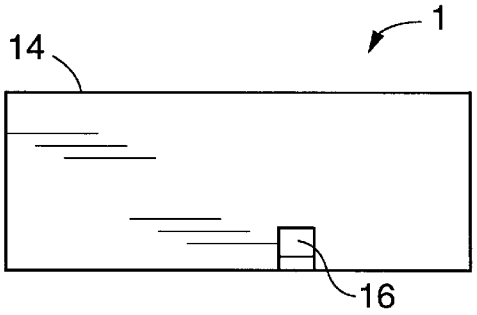
FIG. 1C (PRIOR ART)
Figure 2A:
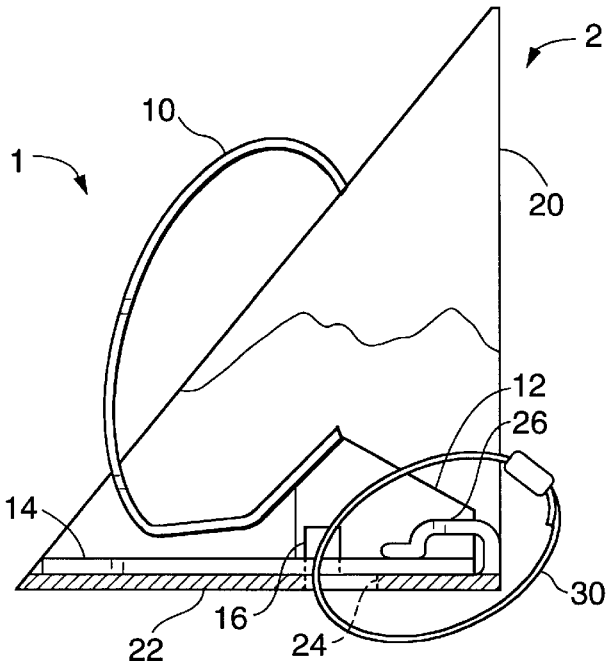
FIG. 2A (PRIOR ART)
FIGS. 2A to 2B two views of a first conventional wristwatch holder assembly.
Figure 2B:
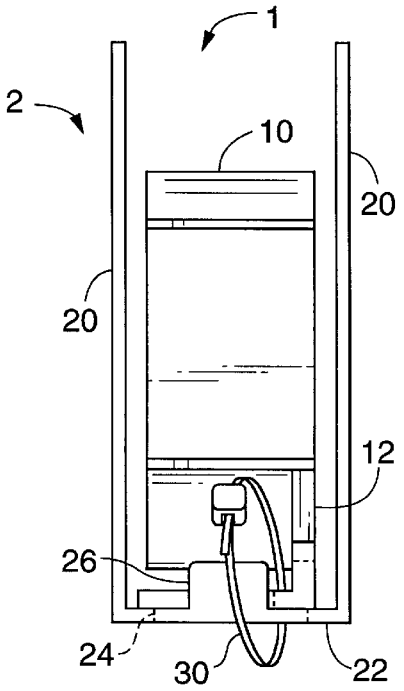
FIG. 2B (PRIOR ART)
Figure 3:
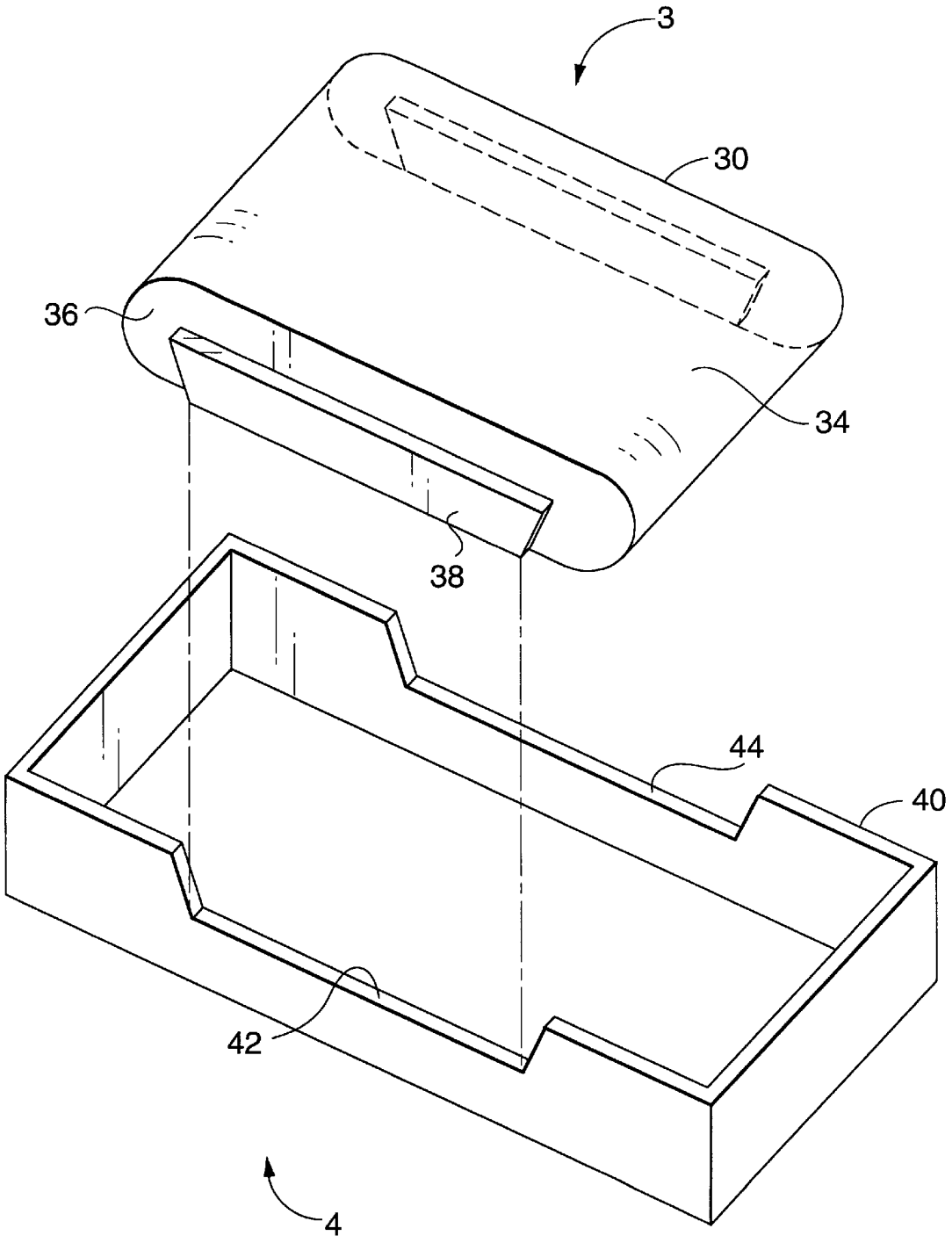
FIG. 3 (PRIOR ART)
FIG. 3 is a perspective view of a second conventional wristwatch holder assembly.
Figure 4C:
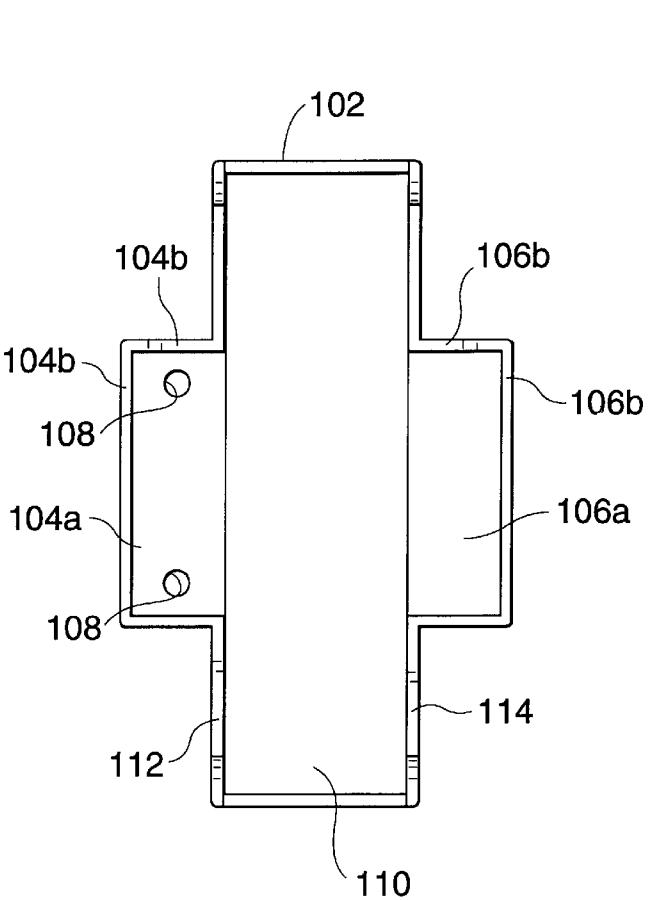
FIGS. 4A to 4C are three views of an embodiment of a wristwatch holder according to the present invention.
Figure 4B:
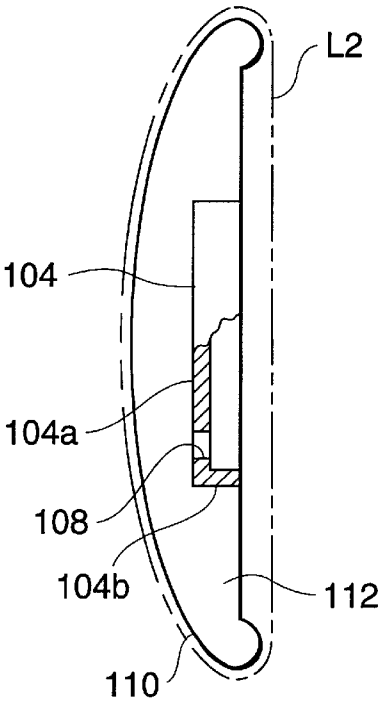
Figure 4A:
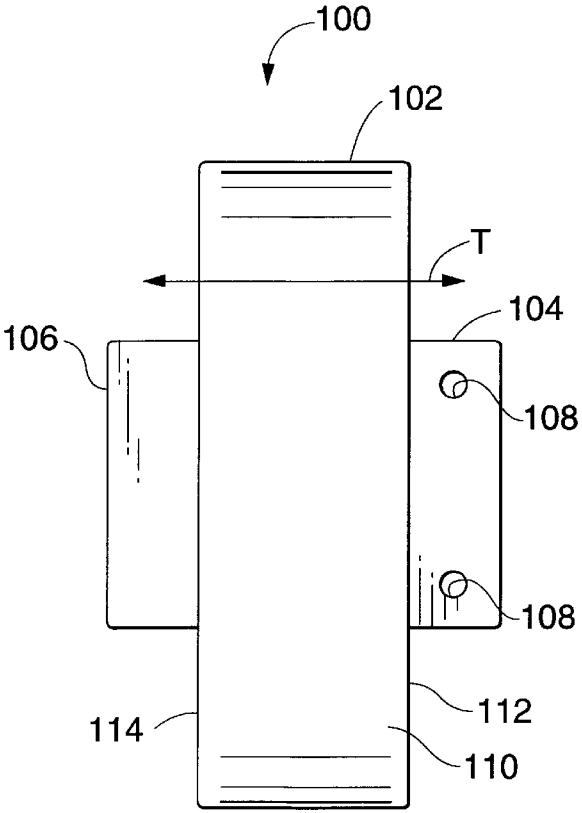

FIGS. 4A to 4C show an embodiment of a wristwatch holder 100 according to the present invention. The wristwatch holder 100 includes a wristwatch support member 102. The wristwatch support member 102 has a curved surface 110 and two peripheral sides 112, 114.

The curved surface 110 of the wristwatch support member 102 is shaped so that a wristwatch (not shown) can be formed into a loop L2 around the wristwatch support member 102. It is noted that while the curved surface defines the loop L2, the curved surface does not follow the entire loop L2. The loop L2 defines a circumferential plane. For example, in FIG. 4B, the circumferential plane of loop L2 is the plane of the page on which FIG. 4B is drawn. The circumferential plane for loop L2 shown in FIG. 4B generally corresponds to the plane of a longitudinal cross-section of a wristwatch placed around the wristwatch support member 102.

The loop L2 also defines a thickness T direction (shown in FIG. 4A), which is perpendicular to the circumferential plane. Flanges (or protruding members) 104 and 106 respectively extend outwards from the peripheral sides 112, 114 of the wristwatch support member 102 in the thickness direction T. One of the flanges 104 has two holes 108 therethrough.

Because the flange 104 extends outwards from the wristwatch support member in the thickness direction T, the wristwatch holder 100 requires relatively few bends and may therefore be more durable and secure than prior holders.

Although the flanges 104, 106 shown in FIGS. 4A to 4C are substantially parallel to the longest dimension of wristwatch holder 102, the flanges 104, 106 can alternatively be formed at other angles. Also, although the flanges 104, 106 shown in FIGS. 4A to 4C extend from roughly the middle of peripheral sides 112, 114, the flanges can be formed to extend outwards in the thickness direction T from other locations on the wristwatch holder 102, such as from the curved surface 110 of support member 102.

As shown in the partially cut away portion of FIG. 4B, and also in FIG. 4C, the flange 104 has a major portion 104*a* and a low ridge 104*b* running around the edge of the major portion 104*a*. Similarly, the flange 106 has a major portion 106*a* and a low ridge 106*b* running around the edge of the major portion 106*a*.

Figure 5C:
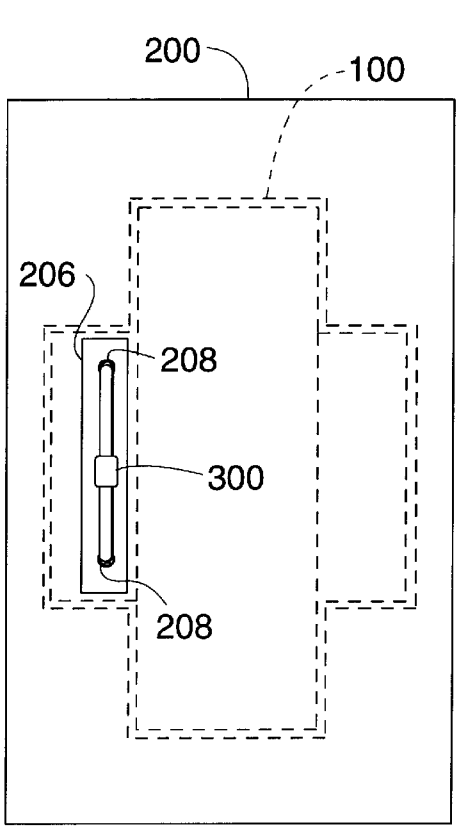
FIGS. 5A to 5C are three views of an embodiment of a wristwatch holder assembly according the present invention.
Figure 5B:
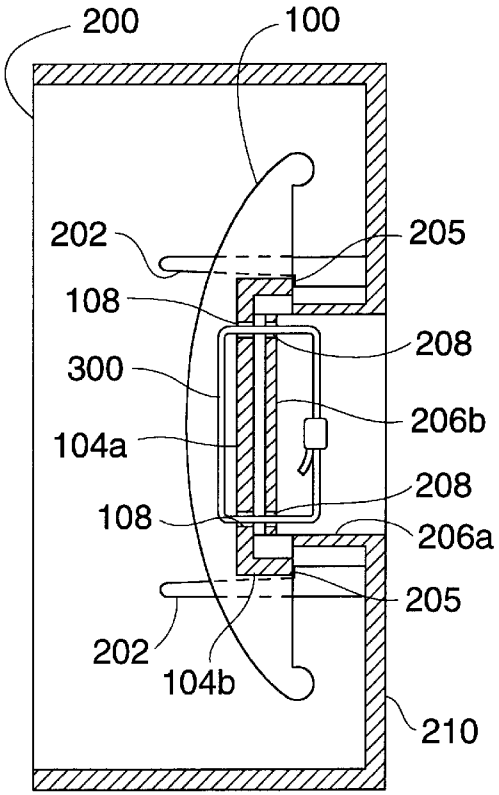
Figure 5A:
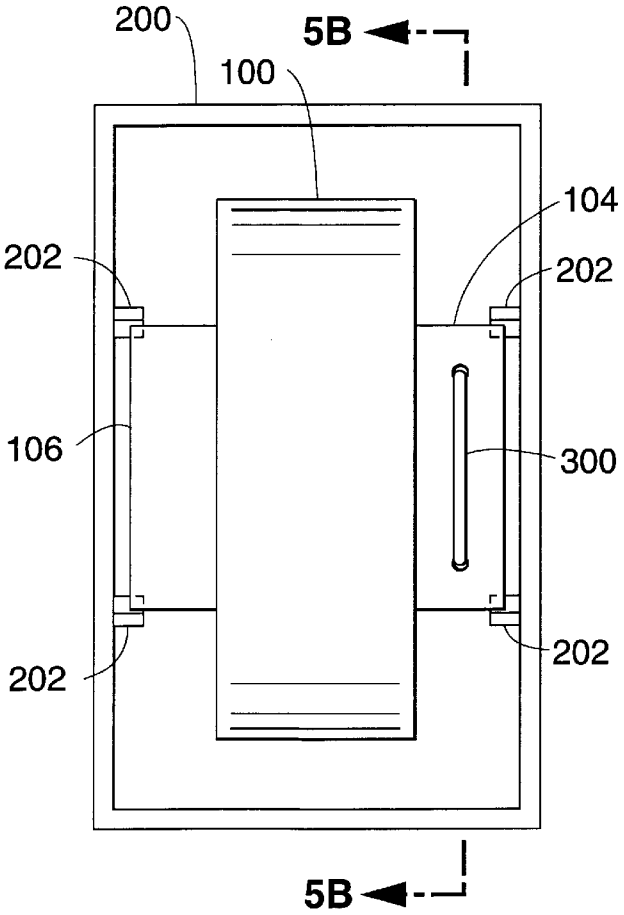

FIGS. 5A to 5C show a wristwatch holder assembly according to the present invention. This assembly includes the wristwatch holder 100 described above in connection with FIGS. 4A to 4C. This assembly also includes a box 200 and a tie-band 300. FIG. 5A shows a top-down view; FIG. 5B shows a sectional view along lines 5B—5B of FIG. 5A; and FIG. 5C shows a bottoms-up view.

As shown in FIG. 5A, the box includes four support rails 202. These support rails guide and support edges of the flanges 104, 106 when the wristwatch holder 100 is placed in the box 200. The support rails 202 also have shoulders 205 which support the bottom comers of flanges 104 and 106 as can be seen in FIGS. 5A and 5B.

FIG. 5B shows a cross-sectional view of the assembly taken along line 5B—5B shown in FIG. 5A. As shown in FIGS. 5B and 5C, the box includes a holder mounting portion 206 which has two holes 208. The holes 208 align with the holes 108 when the wristwatch holder 100 is placed in the box 200. The tie-band 300 runs through the two sets of aligned holes 108, 208 to secure the wristwatch holder 100 to the box 200.

The holder mounting portion 206 has a securable portion 206*b*, which is parallel to the bottom 210 of the box 200. The holder mounting portion also includes a spacer portion 206 which spaces the securable portion 206*b* away from the bottom 210 of the box 200. Because the securable portion 206*b* is spaced away from the bottom 210 of the box 200 by spacer portion 206*a*, the tie-band 300 fits within the outer profile of the box as shown in FIG. 5B. In other words, the bottom surface 210 of box 200 has a recessed portion formed by spacer portion 206*a* and securable portion 206*b*. Holes 208 are formed in the securable portion 206*b* of the recessed portion.

Also, in one embodiment the securable portion 206*b* provides support for the major portion 104*a* of the flange 104. The securable portion 206*a* provides support for the ridge 104*b* of the flange 104. Because the flange 104 is constructed with a ridge 104*b* and because the mounting portion 206 has a spacer portion 206*a*, there is increased support for the wristwatch holder 100, and a more secure assembly can result.

Alternatively, the mounting portion 206 may be made flush with the bottom of the box 210. In other words, the spacer portion 206*a* may be eliminated. Also, the mounting portion 206 may be spaced outwards from the bottom of the box 200 (rather than spaced into the box 200 as shown in the embodiment of FIGS. 5A to 5C).

As a further alternative, while the major portion 104*a* of the flange 104 is parallel to the bottom 210 of the box 200, when the wristwatch holder 100 is assembled with the box 200, the flange and mounting portion may be formed so that the major portion 104*a* of the flange 104 is perpendicular to the bottom 210 of the box 200, or formed at an angle relative to the bottom 210 of the box 200.

As a further alternative, while the embodiment of FIGS. 5A to 5C use a tie-band 300 to secure the wristwatch holder 100 to the box 200, the holder 100 may alternatively be secured to the box 200 by rivets or other types of fasteners.

Figure 6A:
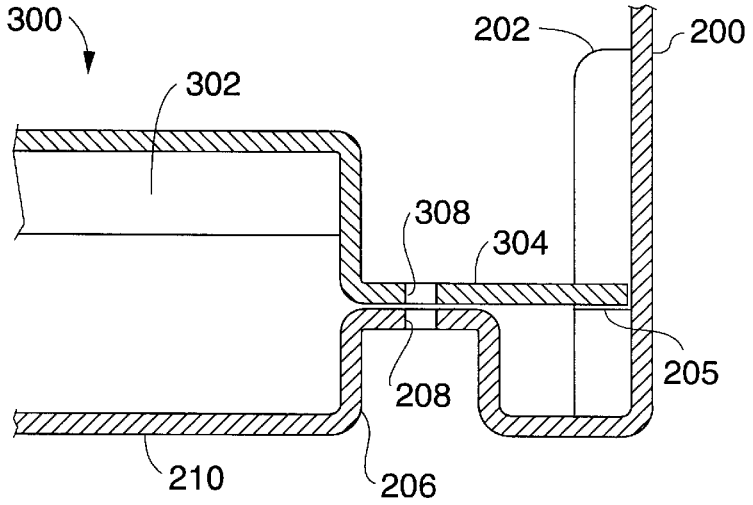
FIGS. 6A to 6C illustrate alternative configurations of a watch holder and box structures in accordance with the present invention.

FIG. 6A shows an alternative embodiment of a portion of a wristwatch holder assembly. The box 200, support rails 202, shoulders 205, mounting portion 206 and holes 208 are the same as the wristwatch box 200 elements described in connection with FIGS. 5A to 5C. The wristwatch holder 300 has a wristwatch support member 302 and at least one flange 304 with a hole 308. As shown in FIG. 6A, the flange 304 is located below the wristwatch support member 302. This illustrates that the flanges can be moved to various positions relative the wristwatch support member as long as they extend outwards in the thickness direction.

Figure 6B:
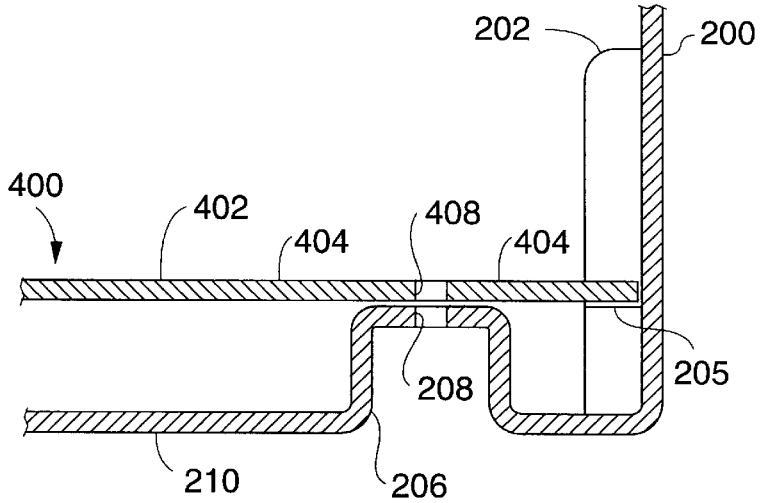

FIG. 6B shows a further alternative embodiment of a portion of a wristwatch holder assembly. The box 200, support rails 202, shoulders 205, mounting portion 206 and holes 208 are the same as the wristwatch box 200 elements described in connection with FIGS. 5A to 5C. The wristwatch holder 400 has a wristwatch support member 402 and at least one flange 404 with a hole 408. As shown in FIG. 6B, the wristwatch support member 402 and the flange 404 are integrally formed as a substantially planar piece.

Figure 6C:
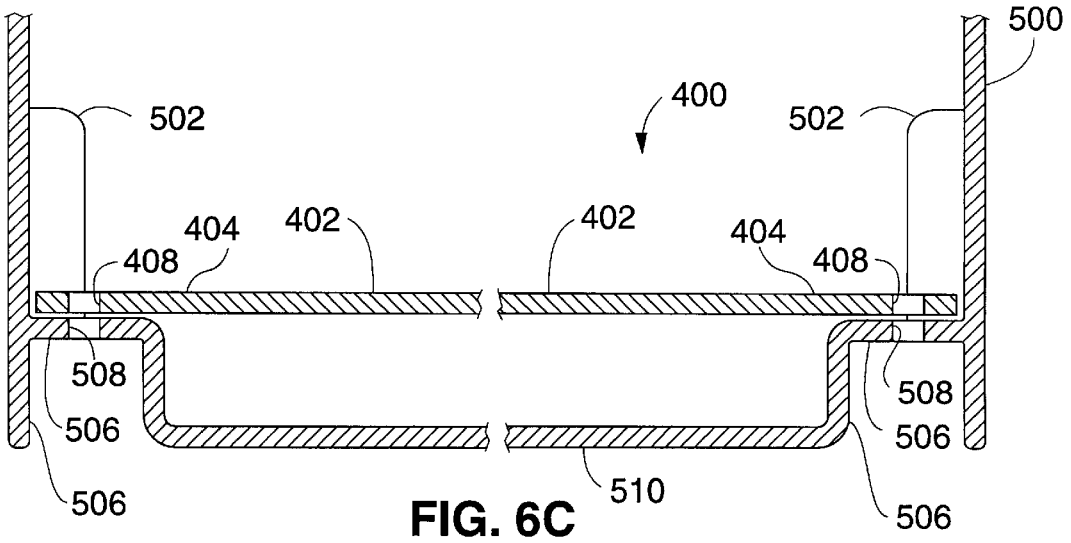

FIG. 6C shows a further alternative embodiment of a portion of a wristwatch holder assembly. The wristwatch shoulder 400 is the same as the wristwatch holder 400 described in connection with FIGS. 6B. The box 500 is somewhat similar to the box 200 described in connection with FIGS. 5A, 5B, 5C, 6A and 6B. More specifically, the box 500 includes support rails 502, mounting portions 506, holes 508 and bottom of the box 510. However, as shown in FIG. 6C, there are two mounting portions 506 which are aligned with peripheral sides of the box 500. Also, the rails 502 do not have any shoulders because the mounting portions 506 support the wristwatch holder 400.

While preferred embodiments of the present invention have been described above using illustrative examples, it will be understood by those skilled in the art that the invention is not limited by the illustrative examples and that various changes and modifications may be made without departing from the spirit or scope of the invention as set forth in the following claims.

What is claimed is:

1. An apparatus adapted for holding merchandise which is capable of being formed into a loop, the merchandise holding apparatus comprising:

a support member shaped to hold the loop, the loop thereby defining a thickness direction which is perpendicular to a circumferential plane of the loop; and a first portion of the support member extending outward from the support member in the thickness direction and having a first hole in a direction generally parallel to the circumferential plane of the loop.

2. The apparatus according to claim 1, wherein the first portion further includes a second hole.

3. The apparatus according to claim 1, wherein:

the support member includes a curved surface for supporting at least a portion of the loop;

the support member includes a first peripheral surface which is formed integrally with and substantially perpendicular to the curved surface; and the first portion is formed integrally with and extends from the first peripheral surface.

4. The apparatus according to claim 3, wherein the support member includes a second peripheral surface which is formed integrally with and substantially perpendicular to the curved surface, and the apparatus further comprises:

a second portion of the support member which is formed integrally with and extends from the second peripheral surface.

5. The apparatus according to claim 3, further comprising:

a first protruding member ridge which is formed integrally with and substantially perpendicular to the first portion around an outer edge of the first portion.

6. The apparatus according to claim 1, further comprising:

a box having a surface which has a hole; and a tie-band running through the hole in the first protruding member and the hole in surface of the the box which secures the support member and first portion to the box.

7. The apparatus of claim 6, wherein the surface of the box which has the hole includes a recessed portion which extends into the interior of the box, and further wherein the hole is located in the recessed portion of the surface.

8. A wristwatch holding assembly for holding a wristwatch formed into a loop, the wristwatch holding assembly comprising:

a wristwatch holder comprising:

a wristwatch support member shaped to hold the wristwatch loop, the loop thereby defining a thickness direction which is perpendicular to a circumferential plane of the loop; and a first protruding member having a first hole and formed integrally with the wristwatch support member, which extends outwards from the wristwatch support member in the thickness direction; and a box adapted to receive the wristwatch holder, the box comprising:

a mounting portion having a first hole located so that the first hole in the first protruding member is aligned with the first hole of the mounting portion when the wristwatch holder is positioned in the box.

9. The wristwatch holding assembly according to claim 8, wherein the first protruding member further includes a second hole, the mounting portion further includes a second hole located so that the second hole in the first protruding member is aligned with the second hole of the mounting portion when the wristwatch holder is in the box.

10. The wristwatch holding assembly according to claim 8 further comprising a tie-band which passes through the first hole in the first protruding member and the first hole in the mounting portion.

11. The wristwatch holding assembly according to claim 8, the box further comprising:

a pair of guide rails which are located to be adjacent to opposite edges of the first protruding member.

12. The wristwatch holding assembly according to claim 11, wherein the guide rails include shoulders for supporting the wristwatch holder within the box.

13. The wristwatch holding assembly according to claim 8, wherein the box has a bottom and the mounting portion further includes:

a securable portion, so that the first hole is formed in the securing portion; and a spacer portion formed integrally with the bottom of the box which spaces the securable portion away from the bottom of the box.

14. The wristwatch holding assembly according to claim 13, further comprising:

a first protruding member ridge which is formed integrally with and substantially perpendicular to the first protruding member around an outer edge of the first protruding member, with the first protruding ridge being located so that the ridge is adjacent to the spacer portion.

15. The wristwatch holding assembly according to claim 13, wherein the securable portion is in contact with the first protruding member.

16. The wristwatch holding assembly according to claim 8, wherein the wristwatch support member and first protruding member are substantially co-planar.

17. The wristwatch holding assembly according to claim 8, wherein the mounting portion has one side aligned with a peripheral side of the box.

18. A wristwatch holding assembly for holding a wristwatch formed into a loop, the wristwatch holding assembly comprising:

a wristwatch holder comprising:

a curved surface shaped to hold the wristwatch loop, the loop thereby defining a thickness direction which is perpendicular to a circumferential plane of the loop;

a first peripheral surface which is formed integrally with and substantially perpendicular to the curved surface;

a first protruding member having a first hole and a second hole and formed integrally with the wristwatch support member, which extends outwards from the first peripheral surface in the thickness direction;

a second peripheral surface which is formed integrally with and substantially perpendicular to the curved surface; and a second protruding member which is formed integrally with and extends from the second peripheral surface;

a box adapted to receive the wristwatch holder, the box comprising:

a mounting portion having a first hole and a second hole respectively located so that the first hole in the first protruding member is aligned with the first hole of the mounting portion and the second hole in the first protruding member is aligned with the second hole of the mounting portion when the wristwatch holder is positioned in the box; and a tie-band which passes through the aligned first holes and the aligned second holes and is fastened to secure the wristwatch holder to the box.

* * * * *